US011795935B2

(12) United States Patent
Devinney et al.

(10) Patent No.: US 11,795,935 B2
(45) Date of Patent: Oct. 24, 2023

(54) WELL PUMP WITH FLOAT CONTROLLED CHECK VALVES

(71) Applicant: PumpOne Environmental, LLC, Cornelius, NC (US)

(72) Inventors: Kerry Shawn Devinney, Cornelius, NC (US); Douglas John Blew, Mooresville, NC (US)

(73) Assignee: PumpOne Environmental, LLC, Cornelius, NC (US)

( * ) Notice: Subject to any disclaimer, the term of this patent is extended or adjusted under 35 U.S.C. 154(b) by 273 days.

(21) Appl. No.: 17/157,276

(22) Filed: Jan. 25, 2021

(65) Prior Publication Data

US 2021/0231117 A1 Jul. 29, 2021

Related U.S. Application Data

(60) Provisional application No. 62/965,375, filed on Jan. 24, 2020.

(51) Int. Cl.
*F04B 49/04* (2006.01)
*F04F 1/08* (2006.01)
*F04B 49/22* (2006.01)

(52) U.S. Cl.
CPC ..... *F04B 49/04* (2013.01); *F04B 49/22* (2013.01); *F04F 1/08* (2013.01)

(58) Field of Classification Search
CPC .. F04B 49/04; F04B 49/22; F04F 1/08; E21B 43/12; E21B 43/121
USPC ..... 417/126, 127
See application file for complete search history.

(56) References Cited

U.S. PATENT DOCUMENTS

| | | | | |
|---|---|---|---|---|
| 1,092,382 | A | 4/1914 | Ness | |
| 1,642,250 | A * | 9/1927 | Langdon | F04F 1/08 417/146 |
| 2,849,963 | A * | 9/1958 | Duby | F04B 47/04 417/147 |
| 3,415,199 | A * | 12/1968 | Elliott | F04F 1/06 417/127 |
| 5,183,391 | A * | 2/1993 | Fiedler | F04F 1/08 417/86 |
| 5,358,037 | A | 10/1994 | Edwards et al. | |
| 5,470,206 | A | 11/1995 | Breslin | |
| 6,095,759 | A | 8/2000 | Breslin | |
| 6,220,823 | B1 | 4/2001 | Newcomer | |
| 6,234,761 | B1 | 5/2001 | Kocsis et al. | |
| 7,316,544 | B2 | 1/2008 | Vidrine | |
| 2017/0321724 | A1 | 11/2017 | Breslin | |
| 2018/0313369 | A1 * | 11/2018 | Breslin | F04F 1/08 |
| 2021/0199109 | A1 * | 7/2021 | Wendland | F04D 29/708 |

* cited by examiner

*Primary Examiner* — Charles G Freay
(74) *Attorney, Agent, or Firm* — Trego, Hines & Ladenheim, PLLC; Brandon C. Trego; Jonathan M. Hines

(57) ABSTRACT

A pump is disclosed. The pump including an outer casing having a cavity therein; a pump assembly positioned in the cavity of the outer casing, the pump assembly including: a discharge tube; a check valve operably connected to the discharge tube by a coupling; and a multi-float control assembly, the multi float control assembly including a bottom float check valve operably connected to the discharge tube by the coupling and an upper float check valve connected to a vent.

15 Claims, 8 Drawing Sheets

WELL PUMP WITH FLOAT CONTROLLED CHECK VALVES

BACKGROUND OF THE INVENTION

This invention relates generally to a pump, and more particularly to a well pump or other air-actuated pump.

Well pumps are employed within and around landfills in order to remove fluids such as leachate and "dewater" the ground water and area within and/or surrounding solid waste landfills. The original source of this water can be from rain falling onto the landfill surface area, surface water flowing into the landfill boundary, or from sub-surface water that flows via a gradient into the landfill boundary. Dewatering the landfill area is done for a variety of reasons: (1) in unlined or failed-lining landfills, the pumps help to prevent the flow of undesirable leachate from leaving the landfill boundary and contaminating the surrounding water table; (2) in lined landfills, a build-up of leachate places undue pressure on the landfill lining and may lessen the integrity of the lining over time; and (3) in many landfills, methane gas is extracted from wells and sold and/or utilized as a fuel source. In order for these wells to function optimally, the level of leachate within the well bore needs to be lowered and kept to a minimum to increase the effective area of methane extraction from within the well.

Well pumps for the above purpose are available from a variety of manufacturers and widely deployed across the global landfill infrastructure. Pumps are generally powered by compressed air or electricity (electric motor-driven pump). The preference for which pump type is deployed normally is dictated by the type of utility services a landfill has in place and distributed around the property—which sometimes cover extremely large land areas. In the cases where compressed air is employed, a pump chamber, located at depth within a well, fills with leachate and then is pumped to the surface and into storage tanks solely via compressed air. Electric pumps contain leachate-level sensors which turn the pump on and off to pump the well down as required.

Air operated pumps come in many different forms. For example, one form of air-operated pump relies on intricate floats, linkages and valving to automatically affect a repetitive fill/discharge/fill . . . cycle of the pump. These actuation elements must be finely tuned and balanced in order to operate in the challenging and varied down-hole environments which are often corrosive, contain particulates/and/or sludge and are at elevated temperatures. The combination of these factors contributes to pump failures after short periods of operation and requires the pump to be pulled from the well and be serviced.

Other forms of air-operated pumps are controlled by remote valves and timing circuits located at ground level above the operating depth of the well pump. The prior-art hardware and control schemes of these pumps have been proven unreliable and often fail in short order due to contamination. The failures result because commercial off the shelf air valves have been employed and configured for an environment they are not capable of operating in for extended periods of time. In particular, the exhaust component of the prior-art pumps must be returned to the surface and processed through a valve which is often through the same valve and supply line that provides the compressed air down the well to the pump. It is the dual use of these lines and valves for air supply and contaminated pump exhaust that introduces the source of contamination into the operating hardware.

Accordingly, there is a need for a pump capable of turning on and off independently of a controller while protecting against contamination.

BRIEF SUMMARY OF THE INVENTION

This need is addressed by the present invention, which provides a pump that includes a multi-float arrangement.

According to an aspect of the invention, a pump includes an outer casing having a cavity therein; a pump assembly positioned in the cavity of the outer casing, the pump assembly including: a discharge tube; a check valve operably connected to the discharge tube by a coupling; and a multi-float control assembly, the multi float control assembly including a bottom float check valve operably connected to the discharge tube by the coupling and an upper float check valve connected to a vent.

According to another aspect of the invention, a pump includes an outer casing having a first end, an opposing second end, and a cavity therein; a pump assembly positioned in the cavity of the outer casing, the pump assembly including: a discharge tube exiting the first end of the outer casing; a check valve operably connected to the discharge tube by a coupling; and a multi-float control assembly, the multi float control assembly including a bottom float check valve operably connected to the discharge tube by the coupling and an upper float check valve connected to a vent exiting the first end of the outer casing.

According to another aspect of the invention, a method of removing fluid from a well using the pump of claim 1, include the steps of moving to a normally open state by moving check valve to an unseated position and allowing fluid to enter the cavity of the outer casing; as the fluid rises in the cavity, using a float of the upper float check valve to seal off the vent; once the upper float check valve has sealed the vent, moving to a normally off state by using compressed air to unseat the float of the upper check valve and fill the cavity with compressed air; and discharging the fluid through the discharge tube.

BRIEF DESCRIPTION OF THE DRAWINGS

The invention may be best understood by reference to the following description taken in conjunction with the accompanying drawing figures, in which.

DETAILED DESCRIPTION OF THE INVENTION

Figure 1:
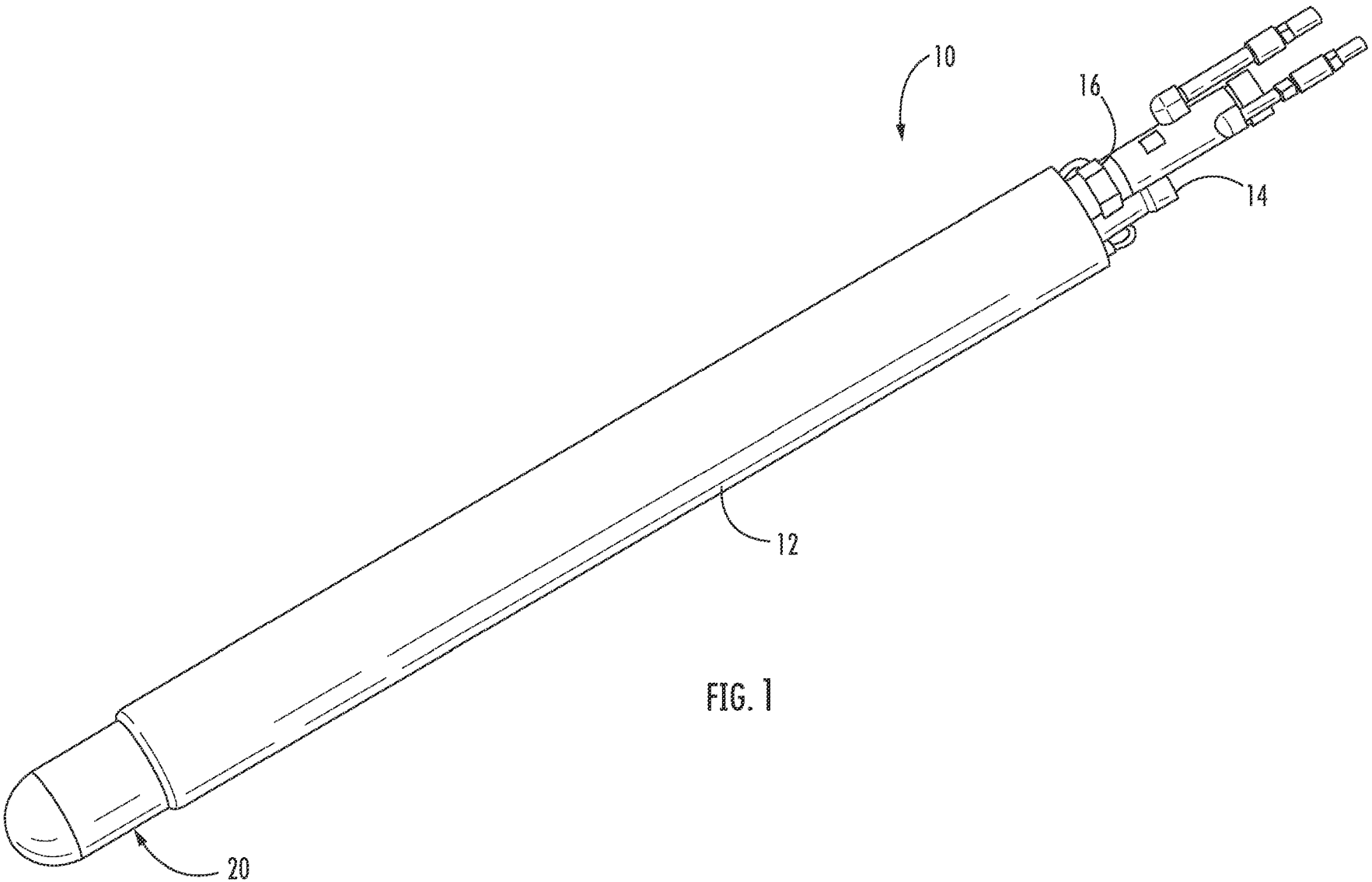
FIG. 1 is a perspective view of a pump according to an embodiment of the invention.
Figure 2:
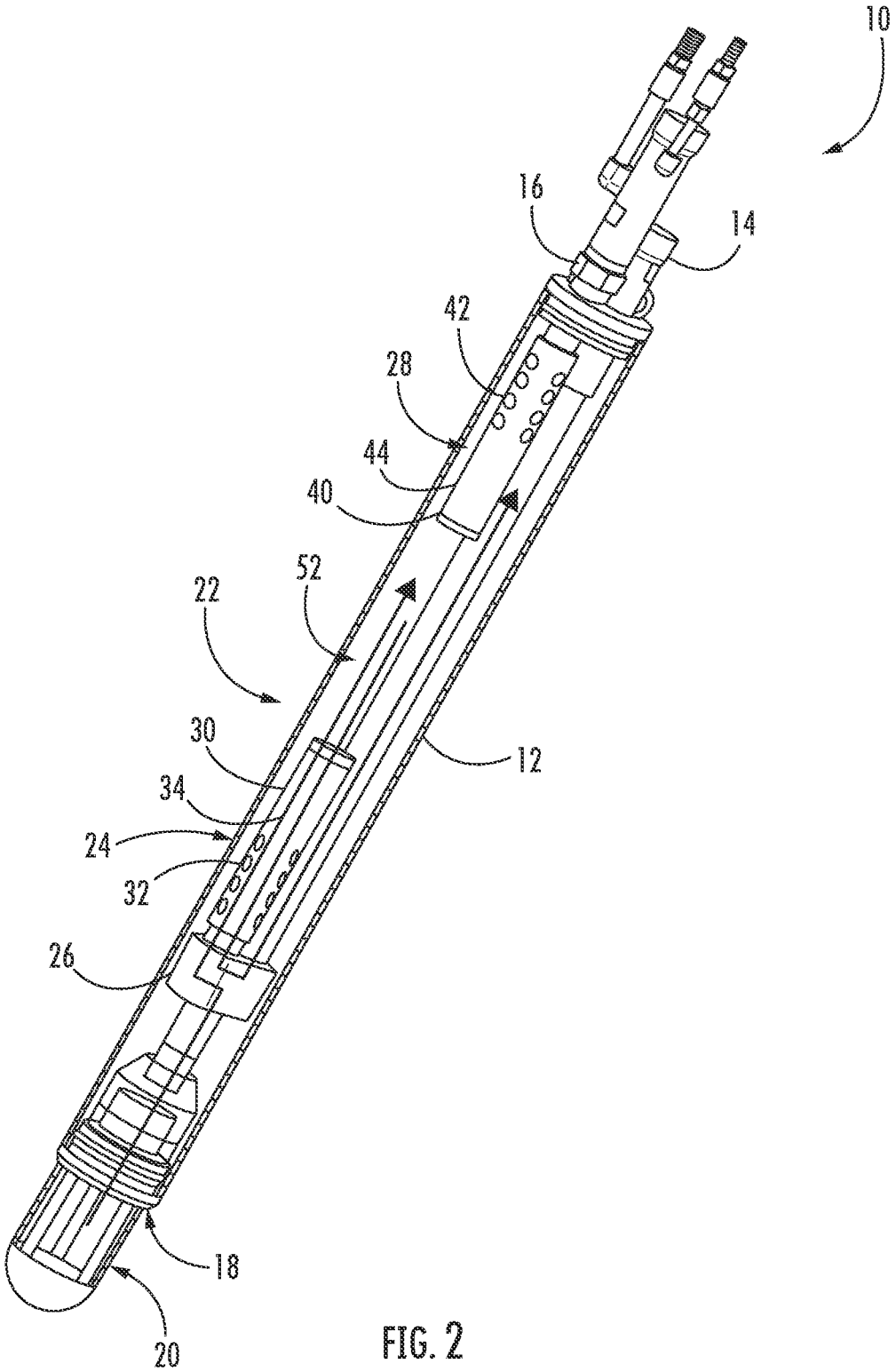
FIG. 2 is a perspective view of the pump of FIG. 1 showing internal components.
Figure 3:
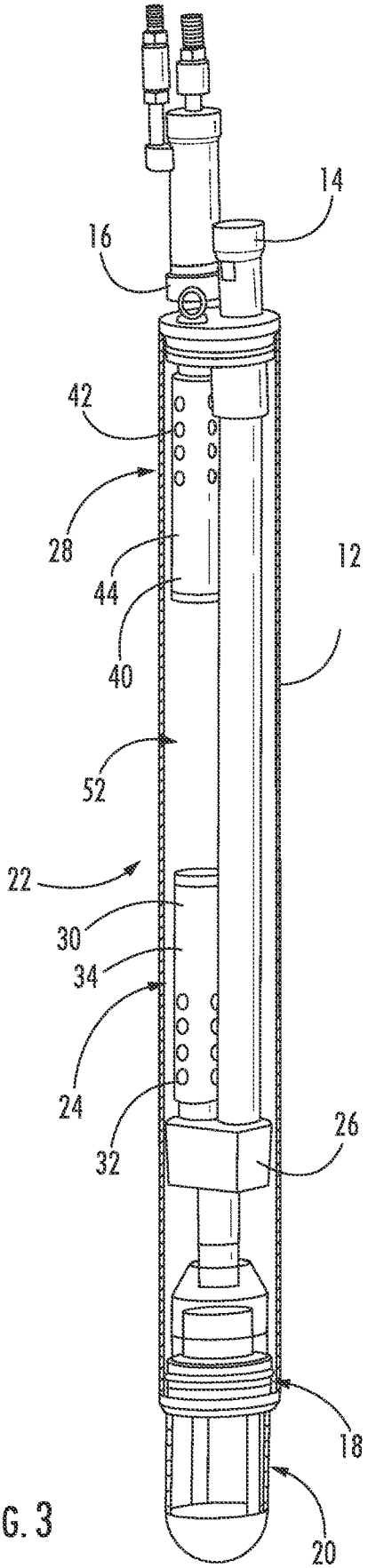
FIG. 3 is a perspective view of the pump of FIG. 1 showing internal components.
Figure 4:
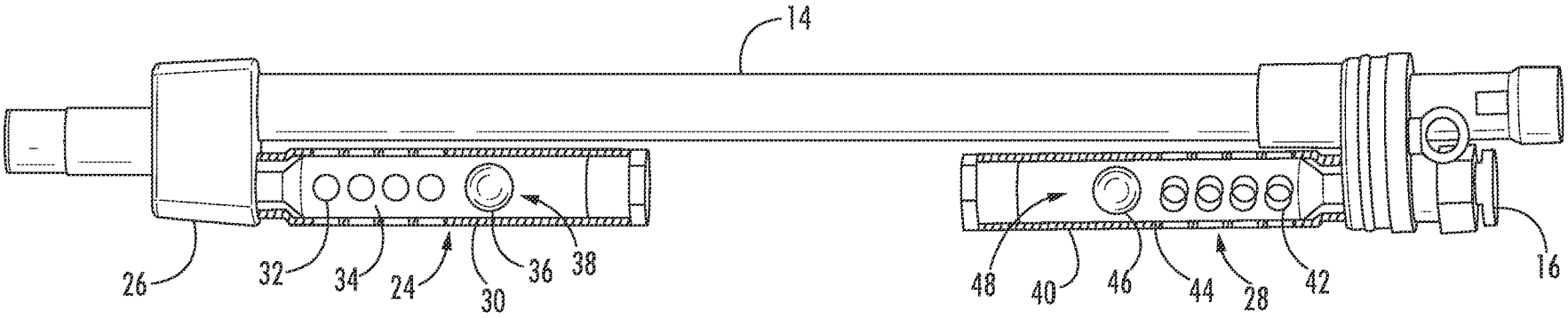
FIG. 4 shows a multi-float control assembly of the pump of FIG. 1.
Figure 5:
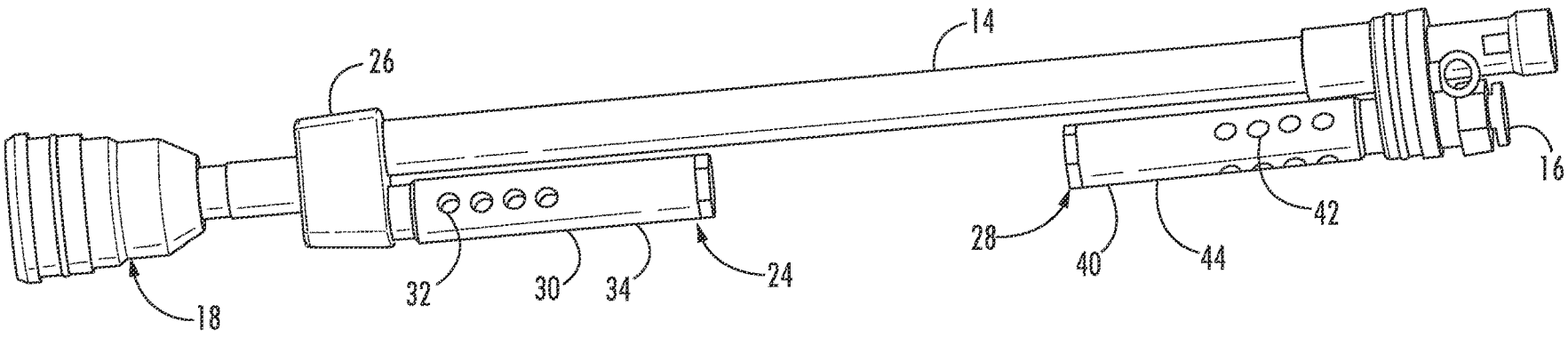
FIG. 5 shows the multi-float control assembly of the pump of FIG. 1.
Figure 6:
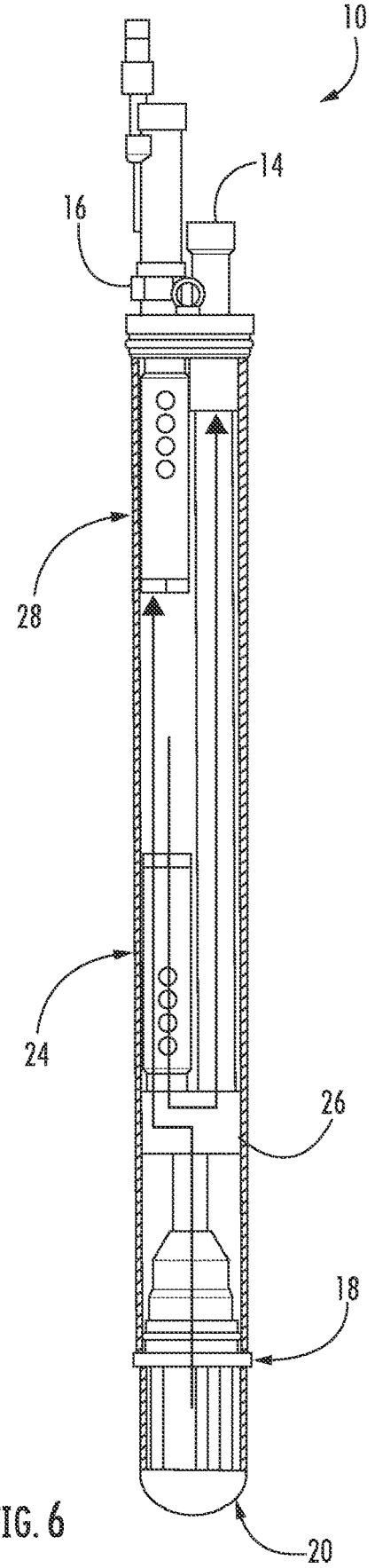
FIG. 6 shows a front elevation view of the pump of FIG. 1.
Figure 7:
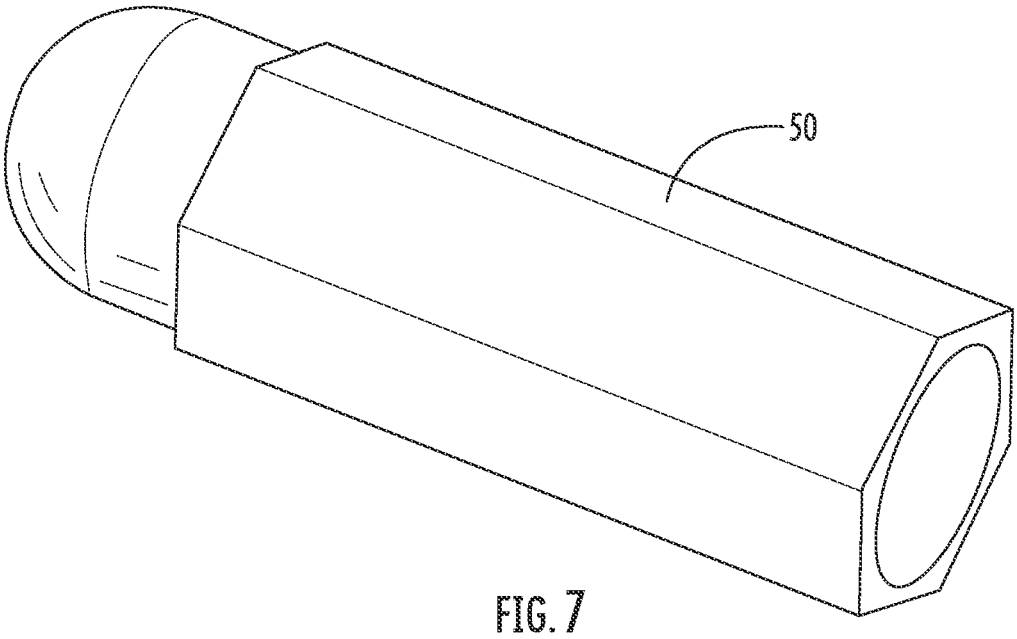
FIG. 7 shows a float for use in the pump of FIG. 1.

Referring to the drawings wherein identical reference numerals denote the same elements throughout the various views, FIGS. 1-7 illustrate an exemplary pump 10 having an outer pump casing 12, a discharge tube 14, and an air/vent port 16. The discharge tube is operably connected to a check valve 18 disposed in a bottom 20 of the pump 10 and a multi-float control assembly 22.

The check valve 18 includes a ball float that, in an unseated position, allows leachate from a well to enter the pump casing 12 and, in a seated position, prevents leachate from being discharged back into the well. The multi-float control assembly 22 includes a bottom float check valve 24 connected to a lower coupling 26 and an upper float check valve 28 connected to the upper air/vent port 16.

Figure 8:
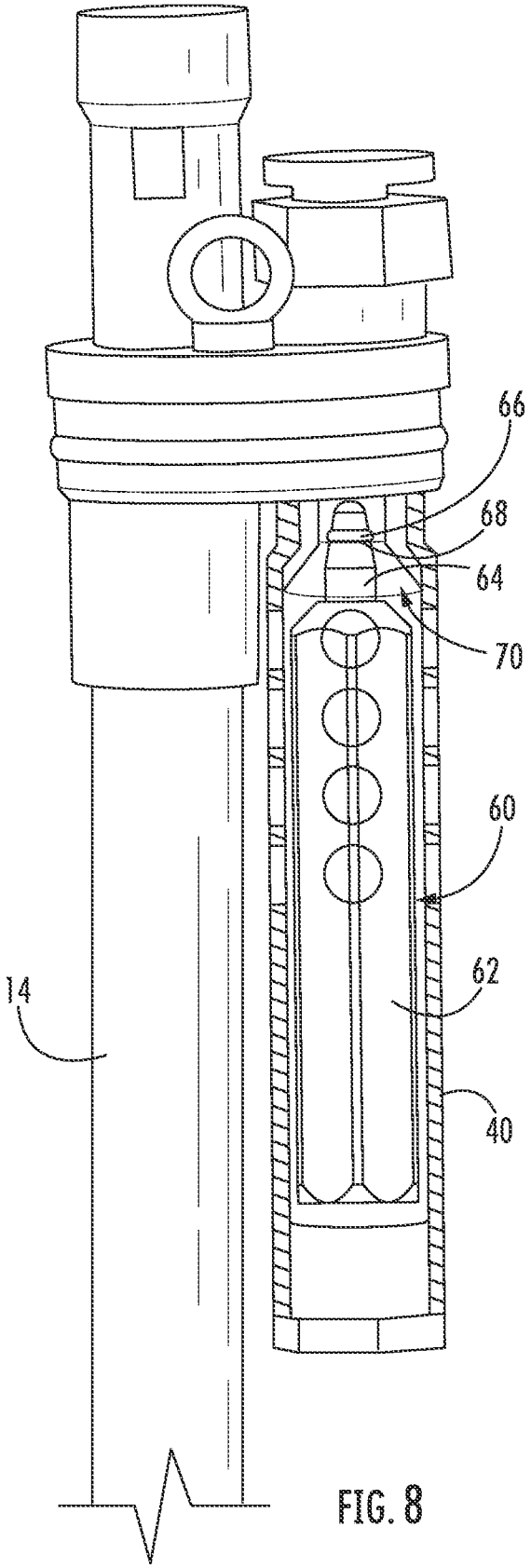
FIG. 8 shows a float for use in the pump of FIG. 1.

The lower coupling 26 operably couples the bottom float check valve 24 and discharge tube 14 together via an internal flow passage. As shown, the bottom float check valve 24 includes a housing 30 having a plurality of apertures 32 formed through a wall 34 of the housing 30. A ball-end float 36 is contained in a bore 38 of the housing 30, the ball-end float 36 being movable between a seated position and an unseated position. Likewise, the upper float check valve 28 includes a housing 40 having a plurality of apertures 42 formed through a wall 44 of the housing 40. A ball-end float 46 is contained in a bore 48 of the housing 40, the ball-end float 46 being movable between a seated position and an unseated position. Bottom and upper float check valves 24 and 28 may also use float 50, FIG. 7, instead of ball-end floats 36 and 46. Additionally, as shown in FIG. 8, the bottom and upper float check valves 24 and 28 may use float 60 instead of ball-end floats 36 and 46. As shown, float 60 includes a body portion 62 and a tip portion 64 having an O-ring seal 66 disposed in a groove 68 therearound. Tip portion 64 is narrower than the body portion 62 and is configured for mating engagement with a seat 70 of housings 30 and 40. It should be appreciated that the bottom and upper float check valves 24 and 28 may include any combination of floats. For example, the bottom check valve my use ball-end float 36 and upper float check valve may use float 60.

While in an exhaust state, if leachate is present external to the pump 10, the leachate liquid is free to flow into the pump 10 via check valve 18. The leachate will fill the pump cavity 52 until one of the following occurs: the leachate level exterior to the pump 10 balances with a level internal to the pump 10 or upper float check valve 28 seals off the upper air/vent port 16. At which point, the accumulated leachate may be expelled through the discharge tube 14.

In operation, during a normally open state, check valve 18 unseats and allows the leachate to enter into the lower coupling 26 and into the pump cavity 52. The leachate flows into the pump cavity 52 via the apertures 32 of the bottom float check valve 24. As the leachate level rises, the ball-end float 36 of the bottom float check valve 24 moves from a seated position to an unseated position by floating up into the housing 30, thereby allowing the leachate to continue to flow into the pump cavity 52.

As the leachate reaches the upper float check valve 28, leachate enters the housing 40 through the apertures 42, thereby causing the ball-end float 46 of the upper float check valve 28 to move from an unseated position towards a seated position at a top of the housing 40. Once ball-end float 46 reaches a top of the housing 40, the ball-end float 46 seals off the upper air/vent port 16 preventing leachate from entering air and vent lines as well as causing the leachate to stop flowing into the pump cavity 52, at which time the pump is full with leachate and ready to be cycled and pumped out. The pump 10 then enters the normally off or air actuated state. In the normally off state, air is supplied through the upper air/vent port 16, pushing compressed air into the pump cavity 52 through the upper float check valve 28, unseating the ball-end float 46, and causing the leachate to move through the bottom float check valve 24, through the lower coupling 24 and out the discharge tube 14.

As the leachate is pushed out the discharge tube 14, the ball-end float 36 of the bottom float check valve 24 begins to move from an unseated position to a seated position. Once the ball-end float 36 is seated, the pump 10 returns to the normally open state and opens the vent 16 to allow more leachate to enter the pump cavity 52. This arrangement keeps the pump from discharging when no leachate is in the pump, overrides any pump controller/timer connected to the pump, and prevents air from entering the discharge tube 14.

The foregoing has described a pump. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends any novel one, or any novel combination, of the features disclosed in this specification (including any accompanying claims, abstract and drawings), or to any novel one, or any novel combination, of the steps of any method or process so disclosed.

What is claimed is:

1. A pump, comprising:

an outer casing having a cavity therein;

a pump assembly positioned in the cavity of the outer casing, the pump assembly including:

a discharge tube;

a casing check valve operably connected to the discharge tube by a coupling, wherein the casing check valve includes a ball float that moves between a seated and unseated position, wherein in the unseated position, fluid is permitted to enter the cavity of the outer casing; and a multi-float control assembly, the multi float control assembly including a bottom float check valve operably connected to the discharge tube by the coupling and an upper float check valve connected to a vent.

2. The pump of claim 1, wherein the coupling includes an internal flow passage to operably connect the discharge tube, casing check valve, and bottom float check valve.

3. The pump of claim 1, wherein the bottom float check valve includes a housing having a plurality of apertures formed through a wall of the housing.

4. The pump of claim 3, wherein the bottom float check valve further includes a float contained in a bore of the housing, the float being moveable between a seated position and unseated position.

5. The pump of claim 1, wherein the upper float check valve includes a housing having a plurality of apertures formed through a wall of the housing.

6. The pump of claim 5, wherein the upper float check valve further includes a float contained in a bore of the housing, the float being moveable between a seated position and unseated position.

7. A method of removing fluid from a well using the pump of claim 1, comprising the steps of:

moving to a normally open state by moving the casing check valve to an unseated position and allowing fluid to enter the cavity of the outer casing;

as the fluid rises in the cavity, using a float of the upper float check valve to seal off the vent;

once the upper float check valve has sealed the vent, moving to a normally off state by using compressed air to unseat the float of the upper check valve and fill the cavity with compressed air; and discharging the fluid through the discharge tube.

8. The method of claim 7, wherein the fluid enters the cavity of the outer casing through apertures in a housing of the bottom float check valve.

9. The method of claim 7, wherein fluid enters the upper float check valve through apertures in a housing of the upper float check valve.

10. The method of claim 7, wherein in the normally off state, the compressed air causes the fluid to enter the housing of the bottom float check valve, through the coupling, and out of the discharge tube.

11. The method of claim 10, wherein the fluid is discharged out of the discharge tube until a float in the bottom float check valve seats to seal off the cavity from the discharge tube.

12. A pump, comprising:

an outer casing having a first end, an opposing second end, and a cavity therein;

a pump assembly positioned in the cavity of the outer casing, the pump assembly including:

a discharge tube exiting the first end of the outer casing;

a casing check valve operably connected to the discharge tube by a coupling, wherein the casing check valve is positioned at the second end of the casing;

a multi-float control assembly, the multi float control assembly including a bottom float check valve operably connected to the discharge tube by the coupling and an upper float check valve connected to a vent exiting the first end of the outer casing: and wherein the casing check valve is operably connected to the discharge tube and bottom float check valve by an internal flow passage in the coupling.

13. The pump of claim 12, wherein the casing check valve includes a ball float that moves between a seated and unseated position, wherein in the unseated position, fluid is permitted to enter the cavity of the outer casing.

14. The pump of claim 12, wherein the bottom float check valve and the upper float check valve each include a housing having a plurality of apertures formed through a wall of the housing.

15. The pump of claim 14, wherein the bottom float check valve further includes a float contained in a bore of the housing of the bottom float check valve, the float being moveable between a seated position and unseated position, and wherein the upper float check valve further includes a float contained in a bore of the housing of the upper float check valve, the float being moveable between a seated position and unseated position.

* * * * *